United States Patent [19]

Birkenstock

[11] Patent Number: 4,559,678

[45] Date of Patent: Dec. 24, 1985

[54] FASTENING STRAPS AND ARTICLES EMPLOYING FASTENING STRAPS

[76] Inventor: Karl Birkenstock, Lohfelder Str. 40, 5340 Bad Honnef, Rhein, Fed. Rep. of Germany

[21] Appl. No.: 537,283

[22] Filed: Sep. 29, 1983

[30] Foreign Application Priority Data

Feb. 24, 1983 [DE] Fed. Rep. of Germany ..... 3306396

[51] Int. Cl.[4] ..... F16L 33/12

[52] U.S. Cl. ..... 24/323; 24/117; 24/144; 24/324

[58] Field of Search ..... 24/323, 324, 173, 180, 24/117, 144

[56] References Cited

U.S. PATENT DOCUMENTS

| | | | |
|---|---|---|---|
| 257,945 | 5/1882 | Hoover | 24/180 |
| 951,727 | 3/1910 | Witt et al. | 24/173 |
| 1,090,333 | 3/1914 | Nadeau | 24/117 R |
| 1,263,605 | 4/1918 | Rust | 24/180 |
| 1,390,776 | 9/1921 | Gardner | 24/323 |
| 1,433,197 | 10/1922 | Gardner | 24/323 |
| 1,575,387 | 3/1926 | Rautio | 24/117 R |
| 1,645,121 | 10/1927 | Stewart | 24/324 |
| 1,785,947 | 12/1930 | Fowler | 24/323 |
| 2,049,414 | 8/1936 | Cohen | 24/324 |
| 3,251,106 | 5/1966 | Collins | 24/324 |

FOREIGN PATENT DOCUMENTS

| | | | |
|---|---|---|---|
| 757310 | 4/1967 | Canada | 24/324 |

*Primary Examiner*—Victor N. Sakran

*Attorney, Agent, or Firm*—Owen, Wickersham & Erickson

[57] ABSTRACT

A fastener for use with a leather or leather-like article having a pair of panels with at least one fastening anchor portion and one strap portion extending toward each other but short of actual contact, the fastening anchor portion having an anchor stud, the strap portion having a series of punch holes extending therethrough. The fastener comprises a flexible bridging strap-like member bridging across between the fastening anchor portion and the strap portion. This bridging member has at one end a stud-receiving portion for coaction with the stud, including an opening for entry and securement of the stud. The other end has a buckle portion for encompassing and sliding along the strap and having a fixed peg projecting therefrom for entering and engaging any one of the punch holes, so as to adjust for size according to which punch hole is so engaged. A bridging strip joins the stud receiving portion to the buckle portion.

23 Claims, 11 Drawing Figures

FASTENING STRAPS AND ARTICLES EMPLOYING FASTENING STRAPS

BACKGROUND OF THE INVENTION

This invention relates to fastening straps for footwear, suitcases, knapsacks, bags, or items of clothing, and to these articles in combination with the fastening straps.

PRIOR ART PRACTICES

Conventionally, some of these articles employ at least one fastener of some kind to secure together two parts, generally made of leather or leather-like material. For example, the upper of most shoes requires some sort of fastener. One such fastener uses a leather strap. Such a fastener may have one fastening element, such as a buckle, attached to one part of the upper, and a leather strap or extension stapled or sewn to and leading from the opposite side of the upper and having a series of perforations or punch holes. This leather strap or extension can be secured and adjusted in length by anchoring it by one of its perforations or punch holes to a fixed tongue or projection.

In the case of footwear, such fasteners are used most frequently on sandals, where a gap in the leather upper is bridged by overlapping two pieces of leather upper. Thus, an adjustable leather-securing strap is conventionally sewn to or stapled to one part of the leather upper and is fastened to the upper on the other side of the gap by a buckle containing a tongue or a press stud. This sort of adjustable fastener makes possible a secure fit and comfortable wear in largely open footwear such as a sandal. In footwear with surgical footbeds the leather upper may similarly be adjusted to the dimensions of the foot.

Since only soft, smooth material is selected for sandal uppers and leather straps, to avoid friction and pressure on the foot, the material used for the straps is fairly thick and wide. However, the leather parts which overlap within the desired adjustment range of the fastener and which are secured to each other by a buckle with a tongue or a press stud mounted between them, constitute a fastener which bulges out considerably beyond the outer surface of the shoe leather. As a result, the force exerted by the foot upon the upper and the fastener is not directly conducted to the uppers over the whole area of the foot, and the material of the upper comes under considerable pressure at the pivoting point formed by the fastener.

Further, a shoe or sandal whose fasteners protrude in this way can easily be caught on various objects.

The manufacture of such a fastener is also relatively costly. For one thing, a tongued buckle is required, typically fastened with staples to the leather upper. The leather strap to be held over the swivelling tongue must cover the whole adjustment range of the fastener, at least to the point on the upper to which the buckle is fixed. Since the parts of the leather upper or straps overlap, one end of each of the straps must be mounted on the leather upper. It is not possible, when using this type of structure, to obtain an adjustable fastening system from a leather upper cut in one piece, since the straps must be separately manufactured and stitched or stapled onto the leather upper.

Also, since the tongued buckle and its point of attachment to the leather upper have to endure considerable stress and must therefore be durable, they have usually been made of metal, and the fasteners become expensive for this reason also.

Although a sandal has been discussed to illustrate the problems, these problems apply also to knapsacks and bags, to suitcases, and to other articles having strap fasteners.

OBJECTS OF THE INVENTION

One object of the invention, therefore, is to provide a fastener for footwear, suitcases, knapsacks, bags or items of clothing having least one fastener which transmits, in a better way than heretofore, the pressure exerted on the outer material (e.g., a leather upper) and on the leather straps and their buckles. For example, in a sandal, the pressure is transmitted to the area of the upper and thence to the upper surface of the foot.

A somewhat related object is to eliminate overlapping of parts, especially of reinforced material.

Another object is to provide a fastener which is of simple construction and is relatively easy and inexpensive to manufacture.

SUMMARY OF THE INVENTION

To achieve these objects, the invention provides a fastener comprising an elongated flat connecting piece with an integrally incorporated buckle element. A securing peg is mounted on the buckle element. The leather strap or extension of the fastener is longer than the gap between the two parts of the material which it is intended to fasten.

The invention may comprise a leather article having a pair of panels with at least one pair of extensions, one being a fastening anchor portion, the other a strap-like portion. These two portions extend toward each other but stop short of actual contact. The fastening anchor portions has a snap stud or some suitable anchor member, while the strap-like portion is integral with its panel and has a series of punch holes extending therethrough. A separate, flexible, flat, strap member bridges across each pair of fastening anchor portion and strap-like portion. One end of this bridging member has at one end an anchor, such as a stud-receiving portion for coaction with the snap stud, including an opening for entry of the snap stud and for tightly engaging and locking the stud. The other end has a buckle for encompassing and sliding along the strap-like portion, the buckle having an immovable peg for entering and engaging any of the punch holes, so as to adjust for size according to which punch hole is so engaged.

As applied to a shoe or sandal having a sole and an upper secured thereto, the upper having a foot-receiving opening between a toe portion and a heel portion, the invention calls for the upper to have on one side of the foot-receiving portion at least one fastening anchor portion extending toward the other side of the upper. On the other side, but short of actual contact with the anchor portion, as a strap-like portion. The heel portion may also have an open end with a fastening anchor portion and a strap-like portion extending toward each other. In such a shoe or sandal, the fastening anchor portion may have has a snap stud or equivalent member, while the strap-like portion is integral with the upper and has a series of punch holes extending therethrough. In such a shoe, there may be one, two or three flexible bridging members, one bridging across each pair comprising a fastening anchor portion and a strap-like portion. Each bridging member has at one end a stud-receiving portion for coaction with the snap stud, including an opening for entry of a snap stud and for tightly engaging and locking the stud. The other end has a buckle for encompassing and sliding along the strap-like portion and has an immovable peg for entering and engaging any of the punch holes, so as to adjust for foot size according to which punch hole is so engaged.

Since the adjustment range is bridged by an elongated flat connecting fastener piece, made out of, e.g., plastic or leather with a suitable buckle element on the end of it and since the parts to be fastened do not overlap, the fastener can be about half as thick as conventional fasteners. As the leather strap-like portions on the shoe or other article are shorter than the gap to be bridged, they can therefore be cut as an integral part of the leather upper, so that there is no need to sew on or staple on special straps is eliminated. The result is a considerable cost saving in the manufacture of footwear, especially those with several fasteners. Similar savings apply to other articles.

Since the stud-receiving portion and the buckle element of the fastening device are fairly rigid, with the fixed securing peg protruding directly from the buckle element, and since the strap of the fastening device is thin and flexible, it lies evenly on the foot, and the fastener will not shift when the strap is secured.

No extra pressures are exerted on the foot at the fastening point, since the two parts of the upper which are fastened together lies on the same level next to each other, i.e., they do not overlap; above all, no part of the fastener mounted between them causes significant protrusion beyond the outer surface of the shoe.

A thin, flat flexible construction is preferred for the connecting piece, so that it will stretch across the gap between the leather strap and the opposite side of the upper. In other words, it is at substantially the same level as the shoe leather.

Since the fastening device with its connecting piece and buckle bridges the entire adjustment range of the fastener and so eliminates the need to mount special leather straps, the manufacture of larger integrated areas of shoe upper is greatly facilitated, and an adjustable and securable upper can be produced from one single leather cutout. This applies also to other articles of clothing and to knapsacks, bags, suitcases, etc.

The connecting piece with its buckle element on one end can be flat except for the securing peg which is a rigid appendage of the (normally) rectangular buckle element. This peg is perpendicular to the forces pulling on the strap; it may protrude upwards or downwards from the buckle. Just as it is desirable for the buckle element to be as thin as possible, it is also important for the forces acting on the securing peg to be evenly distributed, so that it spreads the pressure exerted on the leather strap as evenly as possible across the upper surface of the foot.

On a roughly rectangular buckle element, the peg may be incorporated into the underside of the buckles's rear crosspiece. It should be rigid, and it may point downwardly in one form of the invention. It can extend down as far as the supporting surface of the fastener. In this version the top side of the front crosspiece nearer the end of the buckle is set lower than the top side of the other crosspiece, and the buckle slopes down towards a point below the underside of that other crosspiece in such a way that the leather strap to be fed into the opening in the buckle, i.e., between the two crosspieces, is secured on the downward-pointing peg and is held in place between the top side of the foot and the other crosspiece and is restrained by the end crosspiece.

When the securing peg is incorporated into the end crosspiece of the buckle element, it projects from the lower edge for an amount no greater than the thickness of the leather strap-like portion of the upper. In this way the leather strap can be optimally secured on the peg, since the strap is not only pierced but is also gripped by the peg.

With a fastening element of this type an extremely flat construction is also possible in which the point of contact between the leather strap-like portion and the peg is extremely low. In addition, the end of the leather strap-like portion fed through the buckle lies below the crosspiece or the adjacent end of the connecting piece.

In another form of the invention, the fastener may have a buckle element with a middle bar and two outer, preferably higher, crosspieces, with the stud projecting upwardly from the middle bar. The height of the middle bar can be kept lower than 1 mm., so that the strap can be held down flat, practically against the upper surface of the foot. The front and rear crosspieces serve in this version as restrainers for the leather strap, which is held on the upward-pointing securing peg.

In a favored design the fastening element consists of a one-piece elongated component made of flexible plastic. The length of this component is some 5 cm., while the buckle element and the securing device on the opposite end are each 1 cm. long. Although the connecting piece may be made less than 1 mm. thick, the fastening ends preferably are about 3 mm. thick, on account of the height of the securing peg and the crosspiece above it and on account of the length of the snap stud or the like.

Further advantageous versions of the invention included in the patent claims will become apparent from the following description of some preferred embodiments of the invention.

DESCRIPTION OF SOME PREFERRED EMBODIMENTS

The embodiments of FIGS. 1–4

Figure 1:
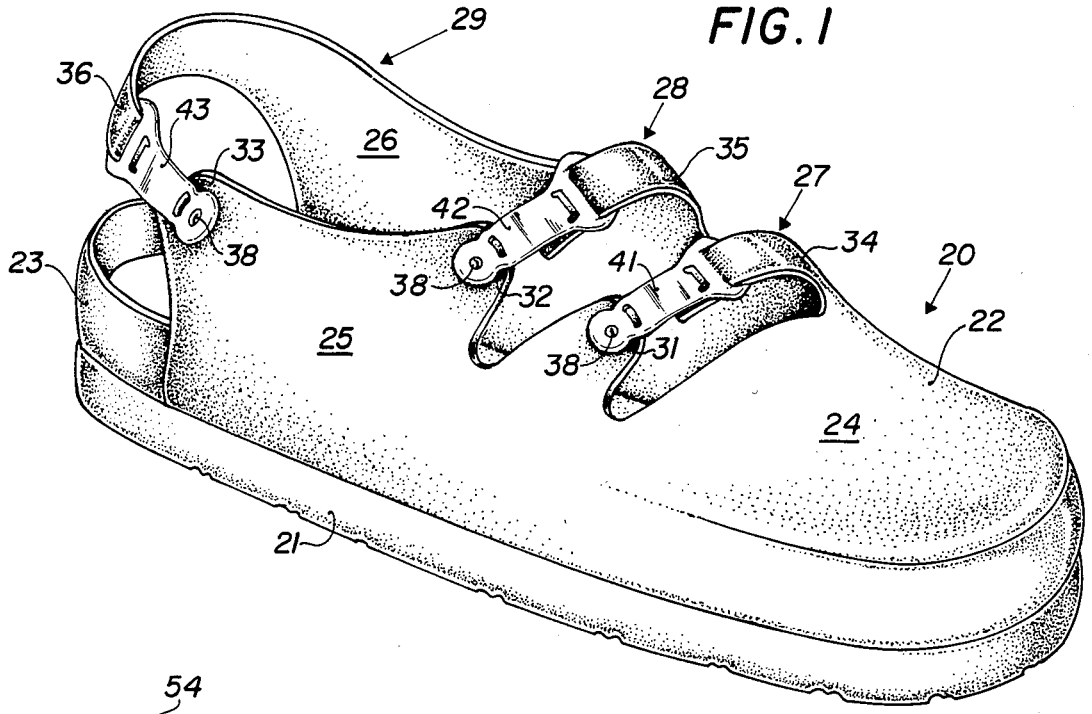
FIG. 1 is a view in perspective of a shoe embodying the principles of the invention.
Figure 2:
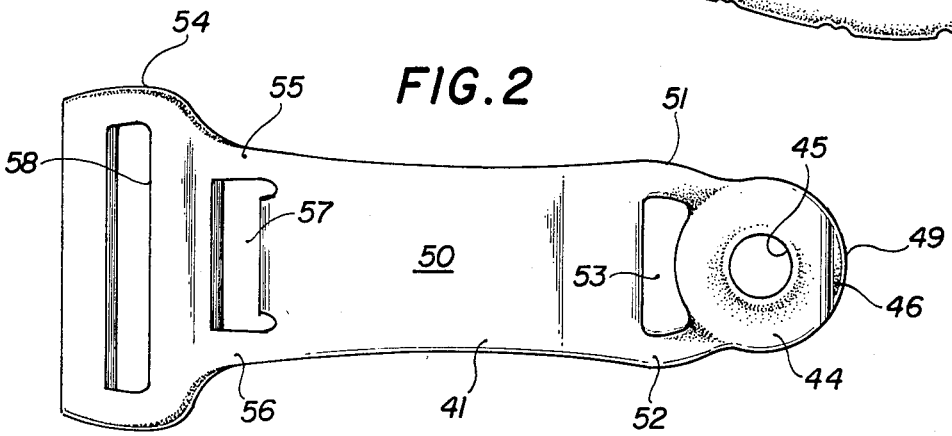
FIG. 2 is a top plan view of a strap of the type shown in FIG. 1 and embodying the principles of the invention. The view is taken from above FIG. 3 along the line 2—2.
Figure 3:
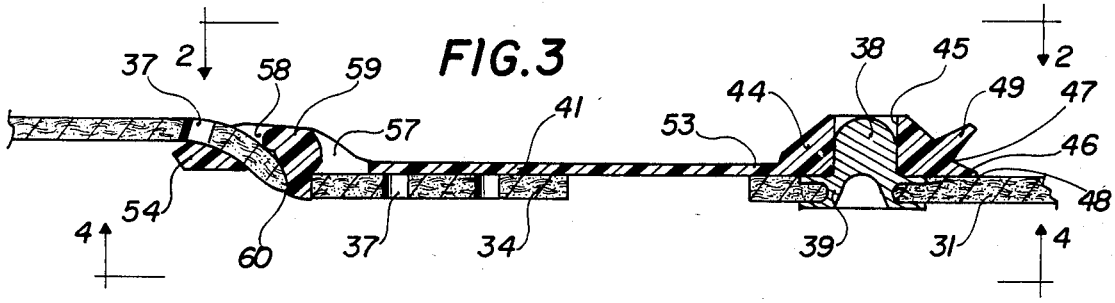
FIG. 3 is an enlarged view in section of the strap of FIGS. 2 and 4, taken along the line 3—3 in FIG. 4.
Figure 4:
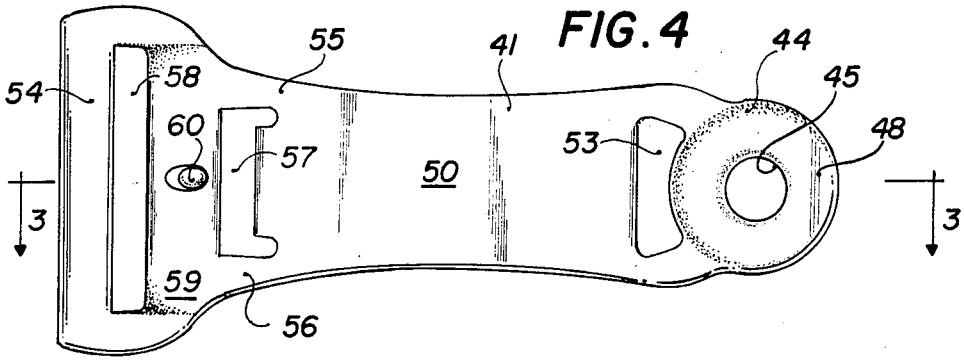
FIG. 4 is a bottom view of the strap of FIGS. 2 and 3, on the sole of FIG. 2 viewed from below along the line 4—4 in FIG. 3.
Figure 5:
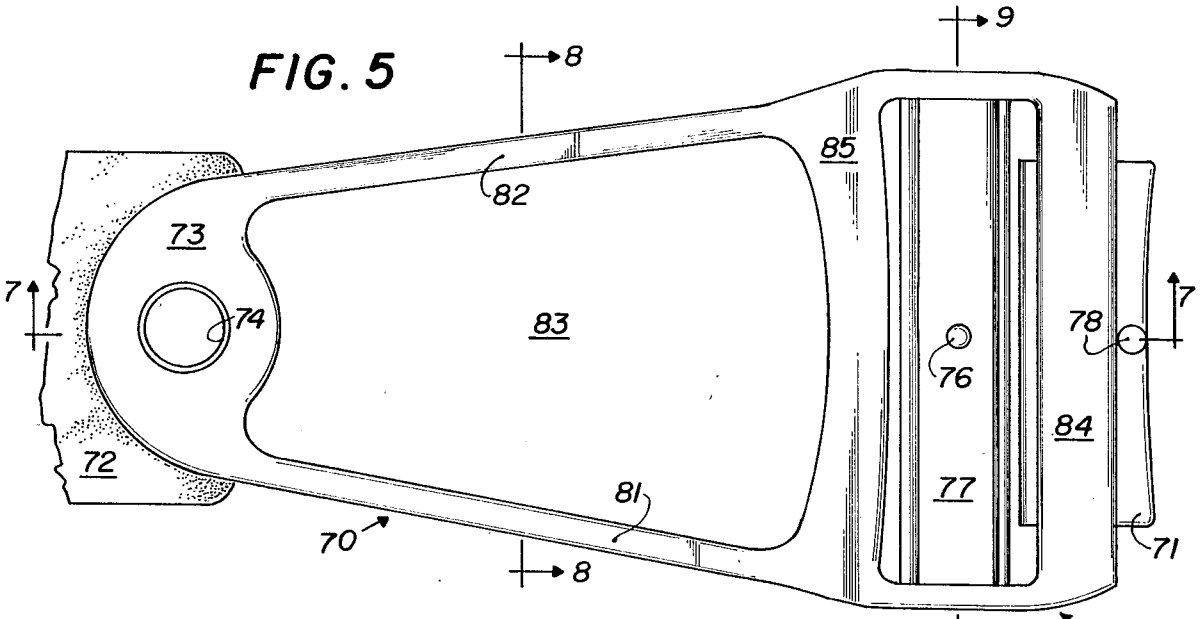
FIG. 5 is an enlarged top plan view of a modified form of fastener strap embodying the principles of the invention.

FIG. 1 shows a shoe 20 having a sole 21, an upper 22, and also an inner sole 23 having a cup-like shape with only the rear portion showing in FIG. 1., although it extends full the length inside the shoe 20. The upper 22 includes a fully covered front portion 24 and, to the rear thereof side portions 25 and 26 between which the foot is inserted.

In place of shoe laces, the shoe 20 is provided with two forward strap assemblies 27 and 28, just to the rear of the front portion 24, for adjusting the shoe 20 to the foot of the user. Further adjustment is obtained at the heel end by a strap assembly 29. These three strap assemblies 27, 28, and 29 comprise embodiments of the principles of the invention and are basically the same, though varied in length.

Thus, the upper portion 25 includes three short integral projections or anchor portions 31, 32, and 33 cut out from the same piece of leather, and the opposing upper portion 26 has short strap-like flaps 34, 35, and 36, also integral with the upper 22. The two members of each pair 31-34, 32-35, and 33-36 do not connect with each other or overlap, and they cannot overlap since they are all cut from the upper 22 and are integral with it.

The flaps 34, 35 and 36 are each provided with a series of punch holes 37, of which there may be three or more on each flap. The anchor portions 31, 32, 33 lie opposite their respective flaps 34, 35, and 36, and each anchor portion is provided with an anchoring stud 38 having an enlarged rounded head portion at its outer end rising above a base 39.

Three novel, flat fastening straps 41, 42, and 43 of the present invention join together the pairs of members 31-34, 32-35, and 33-36. Each strap 41, 42, 43 is preferably molded from a suitable plastic material and comprises at one end a thick stud-engaging portion 44 with a stud receiving opening 45. Preferably the fastening strap 41 is thick enough at the stud engaging portion 44 so that the head of the stud 38 lies below the upper surface of the strap 41. Also, a rounded end 46 of the portion 44 is bifurcated vertically to provide a groove 47 between a lower base 48 and an upper short flap 49 which helps in unsnapping the strap 41 from the stud 38, so that once the strap 41 has been properly adjusted it may be snapped open or closed for taking off or putting on the shoe 20. The base 48 serves to cover the base 39 of the stud 38.

The thick, stud-receiving strap portion 44 is joined to a thin, central main web 50 by two narrow joining portions 51 and 52 with a through opening 53 between them, providing great flexibility at that end of the strap 41. The thin web 50 and the portions 51 and 52 are preferably much thinner than the portion 44 and also much thinner than the upper 22 and its flaps and anchor portions. The web 50 extends across a substantial distance to an integral, thickened buckle portion 54, again being connected by two narrow joining portions 55 and 56 separated by a through opening 57. The through opening 57 provides for great flexibility here.

The buckle portion 54 is substantially rigid, because of its thickness, and surrounds a strap-receiving opening 58. From the bottom surface 59 of the buckle portion 54, a peg 60 projects downwardly, approximately perpendicularly to the surface 59.

In use, the studs 38 are used to attach the stud-receiving end 44 of each fastening member 41, 42, 43 to the anchor portions 31, 32, and 33. The stud 38 is pushed almost through the opening 45, the enlarged head snapping into place.

The flaps 34, 35, and 36 of the upper are then inserted from above or to the outside into their respective buckles 54 and are pulled to a desired position at which the shoe 20 fits comfortably on the foot. Then the peg 60 of each buckle 54 is inserted into or a suitable punch opening 37 of the respective flap 34, 35, and 36. The peg 60 is approximately the same length as or a little shorter than the thickness of the strap 41, so that it does not cause any irritation of the foot, while at the same time it extends far enough into the punch hole 37 to prevent accidental loosening. This basic structure is the same in all three of the fastening assemblies 27, 28, and 29. It thus provides a suitable way of securing the shoe 20 on the wearer's foot, giving the needed comfort and tightness.

The embodiment of FIGS. 5–9

A fastener 70 for a piece of footwear, suitcase, bag or item of clothing, according to FIGS. 5–9, bridges and secures together two leather upper portions 71 and 72 (FIG. 5) that are on opposite sides of a gap. Since the leather upper portions 71 and 72 do not overlap one another, these parts may be parts of a, single member, preferably punched out of shape. Thus, there is no need to secure separate leather straps of footwear material to the upper or outer surface. This results in cost saving in the material needed to produce the fastener.

One end of the fastener 70 is secured by its connecting portion 73 to an anchor portion 72 of the leather outer surface by a rivet 74. Other connecting means may be used instead, such as a press stud, a staple, or a stitching; alternatively, a second buckle element may be used as shown in the embodiment of the fastener according to FIGS. 10 and 11.

The leather strap-like portion 72 is fed into a buckle element 75 forming part of the fastener 70; the buckle 75 has a rigid fixed peg 76 mounted on a cross piece or bar 77 thereof. The total length of the fastener 70 and the leather strap-like portion 71 may be varied by means of a series of punch holes or perforations 78 in the strap-like portion 71, and in any one of those the fixed rigid peg 76 of the buckle element 75 may be secured.

The fastener 70 also comprises, a connecting piece 80, defined by two narrow strips 81 and 82 separated by an enclosed opening 83.

The connecting piece 80 is thin compared to the leather upper portions 71 and 72 and thus will follow the curvature of the upper surface of the foot.

The buckle element 75 incorporated in the fastening element 70 may comprise a rectangular frame with front and rear cross-pieces 84 and 85 and with the flat cross-piece 77 between them, preferably in the middle. The upper surface of the cross-piece 77 in the centre of the buckle 75 is lower than the lower surfaces of the cross pieces 84 and 85. To form a flat supporting surface, the cross piece 77 is sloped to its lower supporting surface, and its upper surface bears the fixed rigid peg 76, which is directed vertically upwardly and to which is secured the leather strap-like portion 71 by engagement in its perforations 78.

The rear and front crosspieces 84 and 85 are spaced from the crosspiece 77 by a distance corresponding to the thickness of the leather strap-like portion 71 above the crosspiece 77. Thus the rear and front pieces 84 and 85 help to hold the leather strap or its perforation at the rigid peg 76.

Because of the flat construction of the connecting piece 80 and of the crosspiece 77 in the centre of the buckle 75, as well as the flat structure of the other parts of the fastener 70, forces acting on the leather strap-like portion 71 are introduced directly into the plane of the anchor portion 72 of the opposite side of the leather upper. Since the fixed rigid peg 76 is vertically incorporated into the upper surface of the crosspiece 77, the forces acting in the plane of the leather outer surface are introduced directly at an angle of 90° vertically to the peg 76; thus there are no tilting forces acting on the fastener 70.

In contrast to conventional fasteners containing a buckle element having a tongue by which one leather strap is connected to the leather outer surface of the shoe, the fastener 70 forms a large supporting surface which is formed by a flat connecting piece and the supporting surfaces of three members 77, 84, and 85.

Figure 6:
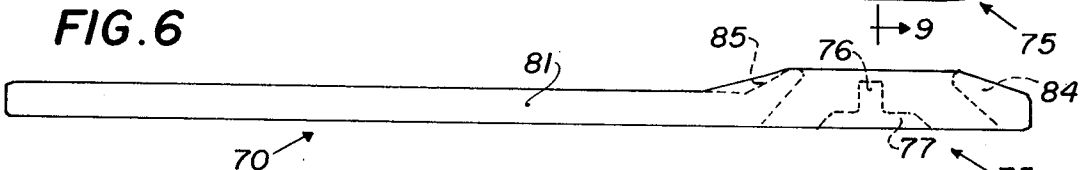
FIG. 6 is a view in side elevation of the fastener strap of FIG. 5.
Figure 7:
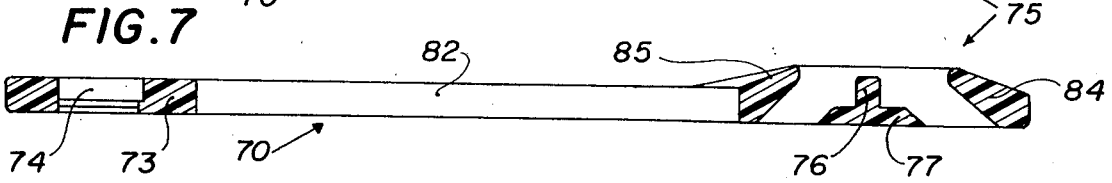
FIG. 7 is a longitudinal cross-sectional view taken along the line 7—7 in FIG. 5.

For much of its length, the connecting piece 80 comprises only the two parallel thin outside straps 81 and 82, through which are transmitted the forces acting on the fastening element 70. The structure of the straps 81 and 82 and of the front and rear crosspieces 84 and 85 at the ends of the buckle element 75 is illustrated by FIGS. 6 and 7, as well as by FIG. 5.

According to the embodiment of FIGS. 5–9 the fastener 70 is formed as a one-piece device, including the connecting piece 80, the buckle 75, and the portion 73. This one-piece fastener 70 is preferably made from flexible plastic material having a length of about 6 cm., the length of its connecting piece 80 being about 4 cm., the length of its buckle element 75 about 1 cm., and the length of the portion 73 about 1 cm. The thickness of connecting piece 80 may be about 1 mm. and the height of the peg 76 about 2 mm. The height of the crosspiece 77 in the center of the buckle 75 may be also about 1 mm., and the thickness of the buckle element 75 about 3 mm.

Figure 10:
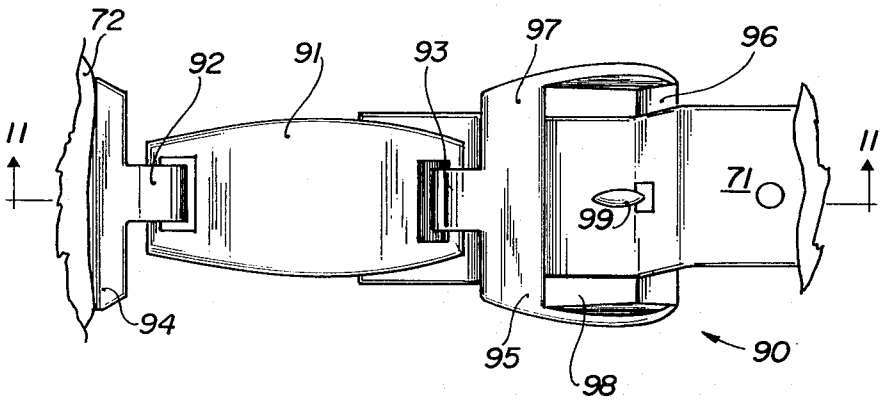
FIG. 10 is a top plan view of a further embodiment of a fastener embodying the principles of the invention.
Figure 11:
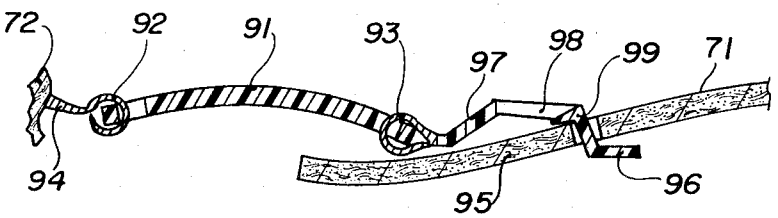
FIG. 11 is a view in longitudinal section taken along the line 11—11 in FIG. 10.
Figure 9:
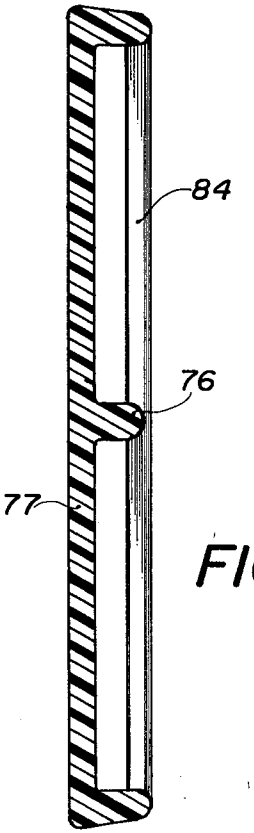
FIG. 9 is a transverse view in section taken along the line 9—9 in FIG. 5.
Figure 8:
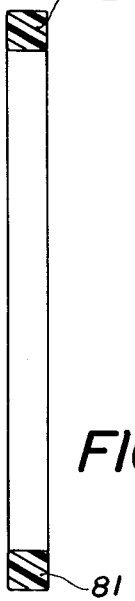
FIG. 8 is a transverse view in section taken along the line 8—8 in FIG. 5.

The embodiment of FIGS. 10 and 11

According to another embodiment of the invention illustrated in FIGS. 10 and 11, a fastening element 90 is not formed as a one-piece plastic fastening element but comprises a connecting plate 91, at the ends of which links 92 and 93 are loosely attached to fastening elements 94 and 95. These parts 91, 92, 93, 94, and 95 may be made from metal.

The linkage of the connecting plate 91 and the fastening elements 94 and 95 and the curvature is such that the fastening element 90 is substantially inflexible in the longitudinal direction when supported by the foot and also adapts to itself the curvature of the foot, because of the links between the connecting part 91 and the fastening elements.

The fastening element 94 is used to secure the connecting plate 91 and thus the fastening element 90 to the anchor portion 72 of the leather outer surface, while the fastening element 95 is used to secure the connecting plate 91 to the opposite side of the outer leather strap-like portion 71. The fastening elements 94 and 95 may be symmetric parts, as shown in FIG. 10.

In FIG. 10 the fastening element 94 is shown only by its front crosspiece, and the leather strap-like portion 71 is not shown.

The two fastening elements 94 and 95 being symmetrical about an axis, each comprises an approximate rectangular frame flexibly connected to the connecting plate 91 and containing front and rear crosspieces 96 and 97 which form an opening 98.

To achieve a flat support of the leather strap-like portion 71 in contact with the surface of the foot in the fastening element 94 and 95, the front crosspiece 96 is mounted on a lower level than the rear crosspiece 97 (see FIG. 6). Also, the front crosspiece 96 is thin, and its upper surface is angled towards a point below the lower surface of the rear crosspiece 97. At the bottom edge of the front crosspiece 96 a peg 99 is formed and rises vertically to a level no higher than the thickness of the leather strap-like portion 71 and then comes to a point which is angled toward the rear crosspiece 97. Thus the peg 99 forms a restrainer for the leather strap, engaging in its perforations. The crosspiece 97 also acts as a restraining means for holding the leather strap-like portion 71 against the outside of the foot.

The height of the peg 99 may be about 3 mm., which is the thickness of the leather strap-like portion 71. The height of the front crosspiece 96 may be only about 0.5 mm.; thus the leather strap-like portion 71 is supported on the upper surface of the front crosspiece near the foot and is fed without difficulty below the lower surface of the rear crosspiece 97 opposite to the surface of the foot.

The lower surface of the rear crosspiece 97 is sloped downs to the foot in the form of a leading surface. Thus the leather strap-like portion 71 may be slid below the rear crosspiece 97 after having been introduced into the opening 98 and being secured to the peg 99.

As the construction of the fastening elements 94 and 95 and the connecting plate 91 is very flat, a force acting in the plane of the leather outer surface of the shoe is introduced according to this embodiment of the fastener of the present invention directly to the opposite parts of the outer leather surface without overlapping leather materials and without tilting forces at the fastener.

The fittings of the fastener may be thin without the danger of damage of a fastener that quickly opens.

In FIG. 11 shows how peg 99 secures the leather strap-like portion 71 in its perforation and how the leather strap-like portion 71 is fed through the opening 98 below the rear crosspiece 97. Also, FIG. 11 shows the formation of the connecting plate 91 and the two links 92 and 97.

To those skilled in the art to which this invention relates, many changes in construction and widely differing embodiments and applications of the invention will suggest themselves without departing from the spirit and scope of the invention. The disclosures and the descriptions therein are purely illustrative and are not intended to be in any sense limiting.

What is claimed is:

1. A fastener for use with a leather or leather-like article having a pair of panels with at least one fastening anchor portion and one strap portion extending toward each other but short of actual contact, said fastening anchor portion having an anchor stud, said strap portion having a series of punch holes extending therethrough, said fastener comprising a flexible bridging strap-like member bridging across between said fastening anchor portion and said strap portion, said bridging member having at one end a stud-receiving portion for coaction with said stud, including an opening for entry and securement of a said stud, the other end having a buckle portion for encompassing and sliding along said strap and having a fixed peg projecting therefrom for entering and engaging any one of said punch holes, so as to adjust for size according to which punch hole is so engaged, and a bridging strip joining said stud receiving portion to said buckle portion.

2. The fastener of claim 1 wherein the fastener is a one-piece plastic member, said stud receiving portion being thicker than the height of said stud and said buckle portion of comparable thickness to assure stiffness, while said bridging strip is thin to provide flexibility.

3. The fastener of claim 1 wherein said bridging strip includes at least one through opening extending most of the width of said strip between narrow connecting portions.

4. The fastener of claim 3 wherein there is a said through opening at each extremity of said strip with a solid portion in between the two through openings.

5. The fastener of claim 3 wherein there is one said through opening extending substantially the full length of said bridging strip.

6. The fastener of claim 1 wherein said strap-like member comprises a series of flexibly joined thin metal members.

7. The fastener of claim 1 wherein said peg projects down from the lower surface of said buckle.

8. The fastener of claim 1 wherein said buckle has a transverse cross piece between the transverse buckle portions and said peg extends up from the center of said transverse cross piece.

9. A leather article comprising a pair of panels with at least one anchor portion and one strap-like portion extending toward each other but short of actual contact, both integral with said panel said fastening anchor portion having an anchor stud, said strap-like portion having a series of punch holes extending therethrough, and a fastener comprising a flexible bridging strap-like member bridging across between said anchor portion and said strap-like portion, said bridging member having at one end a stud-receiving portion for coaction with said snap stud, including an opening for entry and securement of a said snap stud, the other end of said bridging member having a buckle portion for encompassing and sliding along said strap and having a fixed peg projecting therefrom for entering and engaging anyone of said punch holes so as to adjust for size according to which punch hole is so engaged, and a bridging strip joining said stud-receiving portion to said buckle portion.

10. The article of claim 9 wherein the fastener is a one-piece plastic member, said stud receiving portion being thicker than the height of said stud and said buckle portion of comparable thickness to assure stiffness, while said bridging strip is thin to provide flexibility.

11. The article of claim 9 wherein said bridging strip includes at least one through opening extending most of the width of said strip between narrow connecting portions.

12. The article of claim 11 wherein there is a said through opening at each extremity of said strip with a solid portion in between the two through openings.

13. The article of claim 9 wherein there is one said through opening extending substantially the full length of said bridging strip.

14. The article of claim 9 wherein said strap-like member comprises a series of flexibly joined thin metal members.

15. The article of claim 9 wherein said peg projects down from the lower surface of said buckle.

16. The article of claim 9 wherein said buckle has a transverse cross piece between the transverse buckle portions and said peg extends up from the center of said transverse cross piece.

17. The article of claim 16 wherein the buckle has a sloping crosspiece mounted centrally in an opening in a rectangular frame to form a front and rear slot; the sloping crosspiece bearing on its upper surface a fixed said peg such that said front and rear crosspiece serve as a restrainer for the strap-like portion engaged with the peg.

18. The article of claim 16 wherein the buckle has front and rear crosspieces on the same level with a central crosspiece between them having a fixed said peg, said front and rear crosspieces beings higher than the crosspiece having the peg.

19. The article of claim 18 wherein the front crosspiece is mounted at a lower level than the rear crosspiece and the upper surface of the front crosspiece is angled towards a point below the lower surface of the rear crosspiece.

20. The article of claim 21 wherein the peg is incorporated into the lower surface of the rear crosspiece and descends vertically to a level no higher than the supporting surface of the fastening element.

21. The article of claim 19 wherein the peg is incorporated into the upper surface of the front crosspiece and rises diagonally to a height corresponding to the thickness of the leather strap and then preferably comes to a point, which is angled towards the rear crosspiece.

22. A fastener for use with a leather or leather-like article having a pair of panels with at least one fastening anchor portion and one strap portion extending toward each other but short of actual contact, said fastening anchor portion having an anchor stud, said strap portion having a series of punch holes extending therethrough, said fastener comprising a flexible bridging strap-like member bridging across between said fastening anchor portion and said strap portion, said bridging member having at one end a stud-receiving portion for coaction with said stud, including an opening for entry and securement of a said stud, said stud-receiving portion including at its extremity a groove between and parallel to a base and a short flap, to enable disconnecting from said stud, the other end having a buckle portion for encompassing and sliding along said strap and having a fixed peg projecting therefrom for entering said engaging any one of said punch holes, so as to adjust for size according to which punch hole is so engaged, and a bridging strip joining said stud receiving portion to said buckle portion.

23. A leather article comprising a pair of panels with at least one anchor portion and one strap-like portion extending toward each other but short of actual contact, both integral with said panel, said fastening anchor portion having an anchor stud, said strap-like portion having a series of punch holes extending therethrough, and a fastener comprising a flexible bridging strap-like member bridging across between said anchor portion and said strap-like portion, said bridging member having at one end a stud-receiving portion for coaction with said snap stud, including an opening for entry and securement of a said snap stud, said stud-receiving portion including at its extremity a groove between and parallel to a base and a short flap, to enable disconnecting from said stud, the other end of said bridging member having a buckle portion for encompassing and sliding along said strap and having a fixed peg projecting therefrom for entering and engaging any one of said punch holes so as to adjust for size according to which punch hole is so engaged, and a bridging strip joining said stud-receiving portion to said buckle portion.

* * * * *